United States Patent [19]

Griffin

[11] Patent Number: 4,754,518

[45] Date of Patent: Jul. 5, 1988

[54] WET MOP SQUEEZER

[75] Inventor: Dana K. Griffin, Van Wert, Ohio

[73] Assignee: Tu-Way Products Company, Troy, Mich.

[21] Appl. No.: 879,261

[22] Filed: Jun. 27, 1986

[51] Int. Cl.[4] ..... A47L 13/60; A47L 13/59

[52] U.S. Cl. ..... 15/262; 15/261; 68/241; 100/233

[58] Field of Search ..... 15/260, 261, 262, 263, 15/264; 68/241; 100/219, 233

[56] References Cited

U.S. PATENT DOCUMENTS

| | | | |
|---|---|---|---|
| 1,378,879 | 5/1921 | Lawlor | 15/262 |
| 1,388,688 | 8/1921 | Bailhache | 15/262 |
| 1,902,688 | 3/1933 | Cesario | 15/264 |
| 1,922,981 | 8/1933 | Robertson | 15/262 |
| 1,946,637 | 2/1934 | Pavek | 15/261 |
| 2,067,001 | 1/1937 | Palmieri | 15/262 |
| 3,504,393 | 4/1970 | Fosset et al. | 15/262 |
| 3,795,939 | 3/1974 | Seufert | 15/261 |
| 3,921,247 | 11/1975 | Cook | 15/262 |

*Primary Examiner*—John Petrakes

*Attorney, Agent, or Firm*—Robert G. Mentag

[57] ABSTRACT

A wet mop liquid extractor having a rollable support frame carrying a resiliently mounted pressure plate against which a wet mop is supported and from which liquid is to be extracted, and a pressure roller adapted to be brought into rolling pressing contact with the wet mop in a rolling type manner to maximize the squeezing pressure on the mop to extract the liquid therefrom, and a bucket is carried on the support frame beneath the pressure plate to catch the liquid extracted from the wet mop.

7 Claims, 5 Drawing Sheets

WET MOP SQUEEZER

BACKGROUND OF THE INVENTION

1. Technical Field

The field of art to which this invention pertains may be generally located in the class of devices relating to mops. Class 15, entitled Mops and Mop Making, appears to be the applicable general area of art to which subject matter similar to this invention have been classified in the past.

2. Background Information

The wet mop wringers available on the marketplace squeeze or press the yarn of a wet mop by various means, either by means of rollers or pressing the wet mop against a stationary member in a pail. Such prior art mop wringers are for mops involving the use of long yarn. Attempts have been made to use wet mops having mop heads with short yarn, but no prior art wet mop wringer has been provided for effectively squeezing or extracting liquid from a short yarn wet mop.

SUMMARY OF THE INVENTION

In accordance with the present invention, a short yarn wet mop liquid extractor is operatively mounted on a movable support cart for quickly and easily extracting liquid from a short yarn wet mop head, without taking the mop head off of the mop head holder. The support cart includes a support frame which is provided with roller means, and a platform for holding a pair of laterally spaced apart pails for holding liquid. The pails are disposed in a front and rear disposition adjacent to each other. The front pail is provided with clean water to which may be added any desired germicidal or chemical. The rear pail functions as a catch pail for catching liquid extracted from a short yarn wet mop by the extraction means of the present invention. An extraction means is operatively mounted on the support cart in a position over the rear pail, and it includes a vertically disposed, resiliently mounted pressure plate for the positioning against the same of a short yarn wet mop head. In use, a new wet mop head would be put on a mop holder and immersed, in the fluid in the front bucket, and it would then be positioned against the inner face of the resiliently mounted pressure plate. A pressure roller is movably mounted on the support frame in a position facing the resiliently mounted pressure plate. The movable pressure roller is then moved from an inactive or retracted position through a wet mop pressure engaging path, so as to roll over the yarn face of the wet mop in a rolling action, and to extract or squeeze liquid from the wet mop as the roller moves over the yarn face of the mop. The movable pressure roller is moved from an inoperative position and through a liquid extraction operation on the yarn face of a wet mop by a foot pedal and cable operating means, and it is returned to the inoperative position by a retraction means including an air cylinder.

DESCRIPTION OF THE PREFERRED EMBODIMENT

Figure 1:
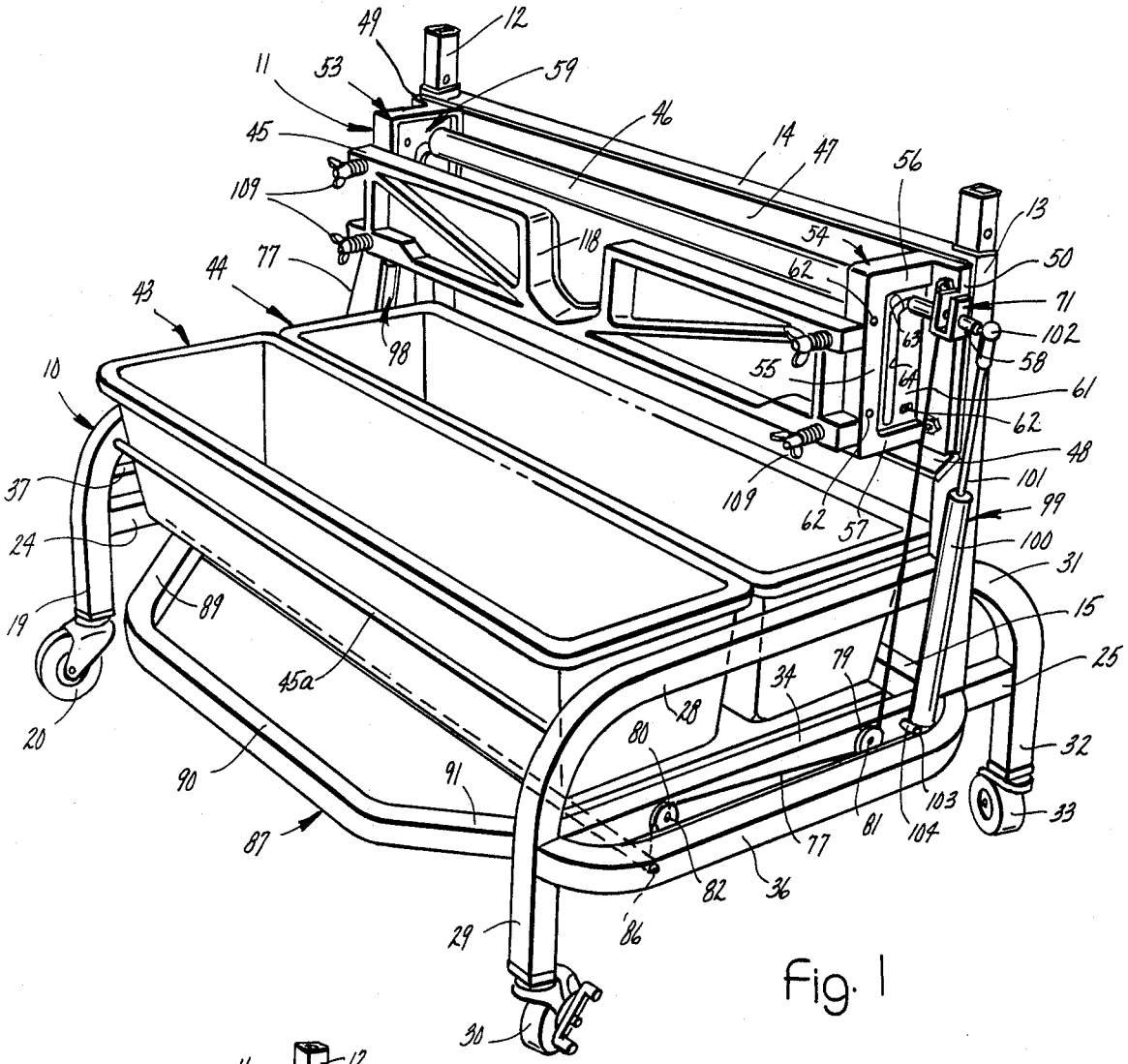
FIG. 1 is an elevation perspective view of a wet mop squeezer made in accordance with the principles of the present invention.
Figure 2:
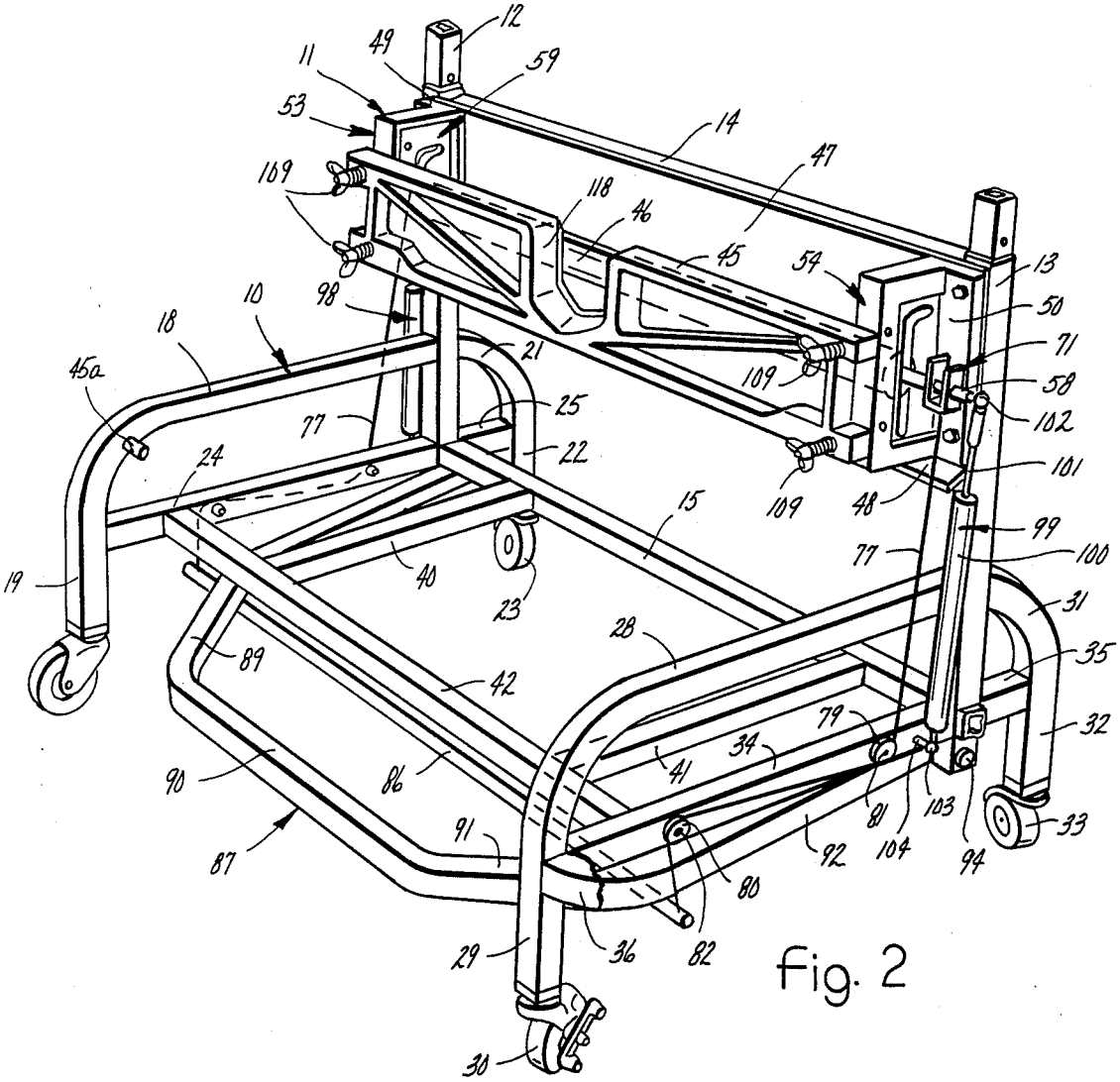
FIG. 2 is an elevation perspective view, with parts broken away, of the wet mop squeezer of the present invention, and showing the two rectangular pails removed and the pressure roller moved to the liquid squeezing operation position cycle.
Figure 3:
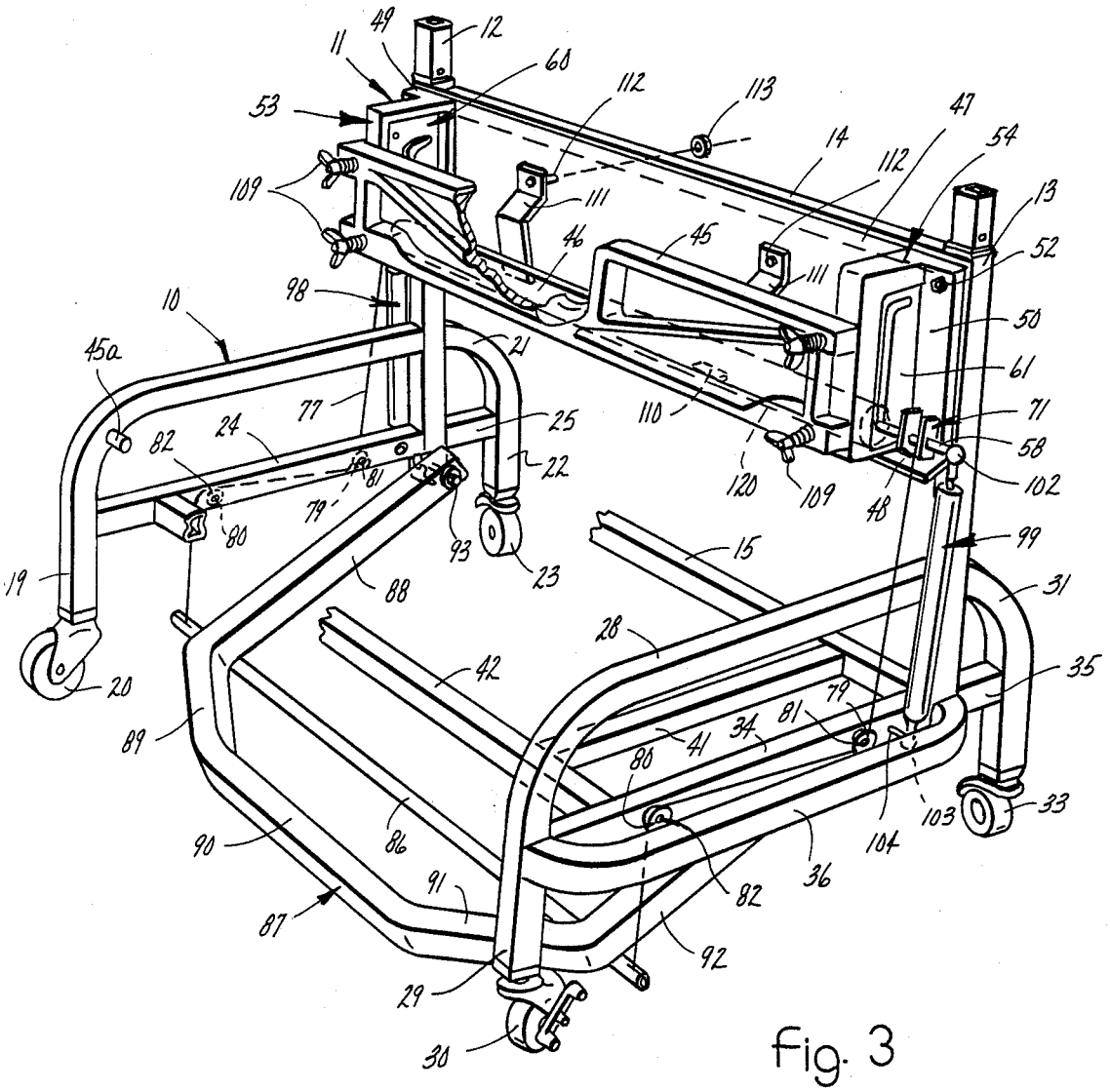
FIG. 3 is an elevation perspective view of the wet mop squeezer of the present invention, with parts removed and parts broken away, and showing the pressure roller at the end of a liquid squeezing operation.

Referring now to the drawings, and in particular to FIGS. 1, 2 and 3, the numeral 10 generally designates a rollable support car which carries a liquid extractor means, generally indicated by the numeral 11. As best seen in FIG. 2, the support car 10 includes a vertical frame portion that comprises a pair of vertical, elongated, spaced apart support members 12 and 13, which may be connected at their inner ends to a suitable horizontal handle member, if desired. A pair of vertically spaced apart, transverse frame support members 14 and 15 are mounted between the two vertical support members 12 and 13, and they are fixedly attached thereto by any suitable means, as by welding. The last described parts of the support cart 10, and the hereinafter described support cart parts, may be made from any suitable material as, for example, tubular stainless steel.

As best seen in FIG. 2, the support cart 10 includes a front left horizontal side arm 18 which is fixedly connected, as by welding, at its rear end to the vertical frame support member 12. The front end of the cart frame side arm 18 is curved downwardly, and terminates at a leg 19, on the lower end of which is operatively mounted a suitable static free castor or roller 20. A rear side arm 21 is fixedly attached to the rear side of the vertical frame support member 12, by any suitable means, as by welding The rear side arm 21 extends rearwardly and curves downwardly to form a leg 22, which has operatively mounted on the lower end thereof a suitable static free castor or roller 23. The left side of the frame for the support cart 10 further includes a front horizontal brace or support member 24, which is disposed below the side arm 18 and fixedly attached at its rear end to the front side of the vertical frame support member 12, and at its front end to the leg 19, by any suitable means, as by welding. A rear horizontal brace or support member 25 is mounted between the vertical frame support member 12 and the rear leg 22, aligned with the brace 24 and it is fixedly connected to these members by any suitable means, as by welding.

The support cart 10 also includes a right front horizontal side arm 28, which has its rear end fixedly secured, as by welding, to the vertical frame support member 13. The front end of the cart frame side arm 28 curves downwardly, and the lower end thereof forms a leg 29, on the lower end of which is operatively mounted a suitable static free castor or roller 30. The support cart 10 further includes a right rear side arm 31 which is fixedly secured, as by welding, to the rear side of the vertical frame support member 13, and it extends downwardly to form a leg 32. A suitable static free castor or roller 33 is operatively mounted on the lower end of the leg 32. The frame for the support cart 10 further includes on the right side a horizontal forwardly and rearwardly extended brace or support member 34, which is disposed below the side arm 28 and interconnects the front end of the vertical frame support member 13 and the rear side of the leg 29. The brace 34 is fixedly connected to the vertical frame support member 13 and the leg 29 by any suitable means, as by welding. A rear brace member 35 has its rear end attached to the rear side of the vertical frame support member 13, and it is aligned with the brace 34. The rear end of the brace 35 is connected, as by welding, to the front side of the leg 32.

As shown in FIG. 3, the support cart 10 is provided with a horizontal, outwardly and sidewardly extended fender or bumper 36, which is fixedly connected at its front and rear ends by any suitable means, as by welding, to the cart leg 29 and the vertical frame support member 13, respectively The left side of the support cart 10 is also provided with a similar bumper 37, which is partially shown in FIG. 1.

Figure 4:
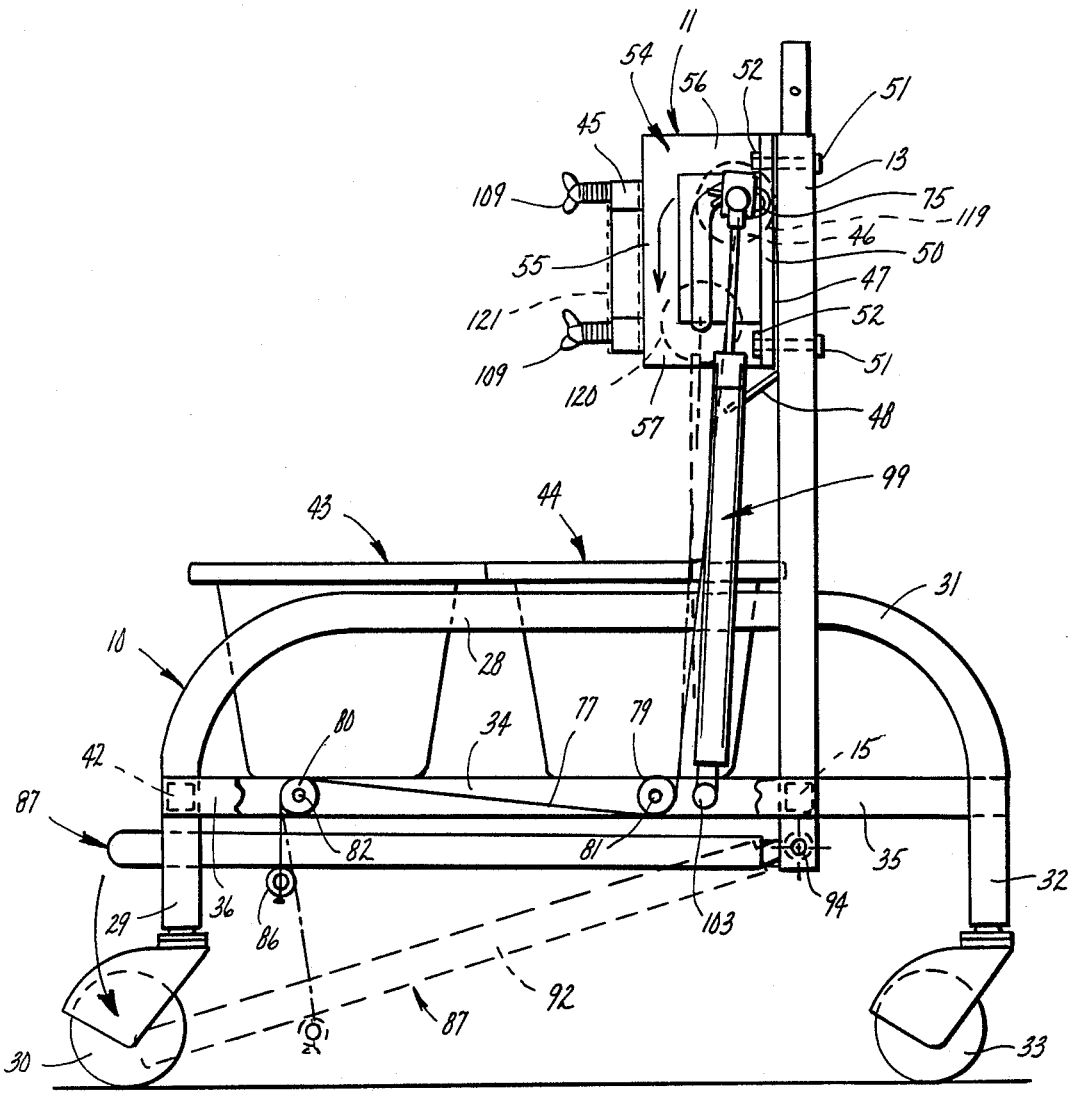
FIG. 4 is a right side elevation view of the wet mop squeezer illustrated in FIG. 1, with parts removed, and showing the pressure roller in an inoperative position and in a position at the end of the liquid squeezing operation.

As best seen in FIG. 2, the support cart 10 is provided with a pail or bucket supporting platform, comprising a left horizontal member 40 and a right horizontal member 41, and the rear ends of these members are fixedly secured, as by welding, to the inner side of the transverse support member 15. The front ends of the platform members 40 and 41 are fixedly secured, as by welding, to a transverse platform member 42. The transverse platform member 42 is fixedly connected at its ends to the side arm members 24 and 34, by any suitable means, as by welding. As shown in FIGS. 1 and 4, the aforementioned pail supporting platform is adapted to have releasably seated thereon a pair of elongated, rectangularly shaped pails or buckets, generally indicated by the numerals 43 and 44. As shown in FIG. 1, the pails 43 and 44 are retained against forward sliding movement by a transverse retainer bar 45*a*, which has its outer ends fixedly connected, as by welding, to the curved upper ends of the front leg portions 19 and 29.

As shown in FIGS. 1 and 2, the liquid extractor means 11 includes a resiliently mounted pressure plate 45, against the inner side of which a short yarn wet mop is adapted to be disposed, and a pressure roller 46 which is adapted to roll over the surface of the yarn on the wet mop and extract the liquid therefrom, as more fully explained hereinafter. The pressure plate 45 and the pressure roller 46 are operatively mounted on the support cart 10 by the following described structure.

As best seen in FIGS. 2 and 4, the liquid extraction means 11 includes a vertically disposed mounting plate 47, which has its ends positioned on the front face of the vertical support members 12 and 13, and which is provided at the lower end thereof with an integral, inwardly extended splash guard 48. The mounting plate 47 is detachably secured to the support members 12 and 13 by a pair of left and right vertical attachment members in the form of bars, and which are indicated by the numerals 49 and 50, respectively. As best seen in FIG. 4, the attachment bar 50 is secured to the vertical support member 13 by a pair of vertically spaced apart bolts 51 and nuts 52. The attachment bar 49 is identically secured to the vertical support member 12, in the same manner as the vertical attachment bar 50 is secured to the support member 13.

As best seen in FIGS. 1 and 4, the pressure roller 46 is operatively supported by a pair of left and right U-shaped carrier brackets, generally indicated by the numerals 53 and 54. The right side U-shaped carrier bracket 54 is formed from three pieces of angle iron which are welded together to provide a vertical portion 55, an upper horizontal portion 56, and a lower spaced apart horizontal portion 57. The free ends of the horizontal angle iron portions 56 and 57 are fixedly secured to the front face of the vertical attachment bar 50 by any suitable means, as by welding. The left side U-shaped carrier bracket 53 is also formed from three pieces of angle iron, and is fixedly secured to the left side attachment bar 49 in the same manner as the right side U-shaped bracket 54, and the corresponding parts are marked with the same reference numerals.

Figure 5:
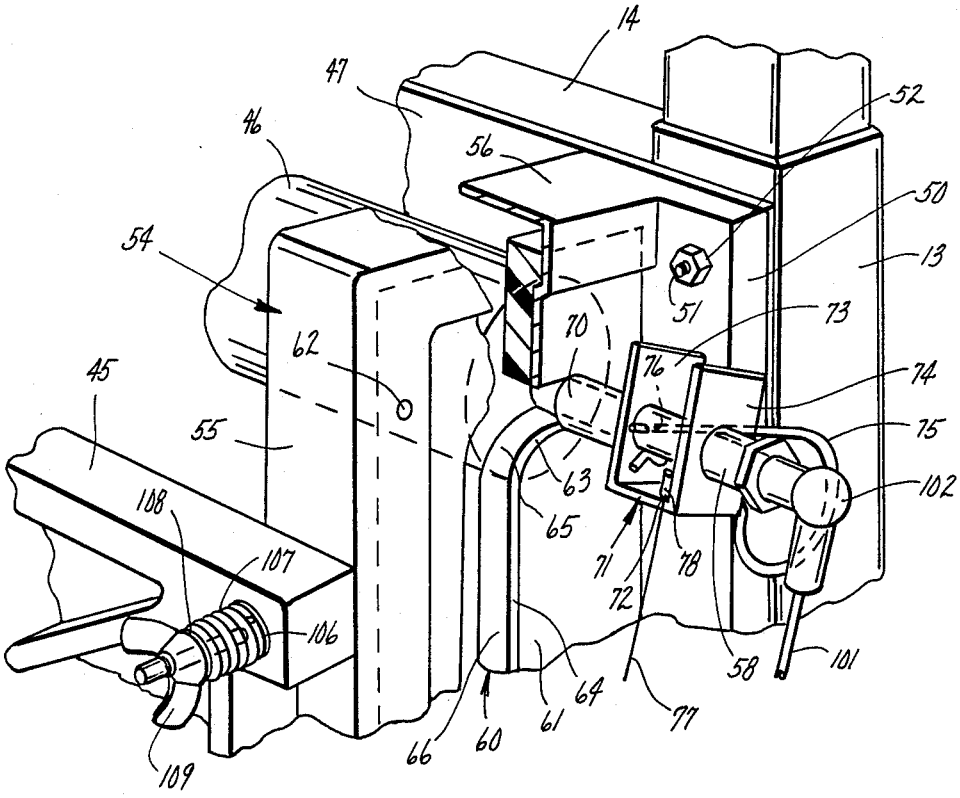
FIG. 5 is a fragmentary, enlarged, elevation perspective view of the one end of the pressure roller, and showing the mounting structure therefor.

The pressure roller 46 is operatively mounted at each end thereof, on the left and right carrier brackets 53 and 54, by the same identical mounting structure, and the mounting structure for the right end thereof will be described, and it will be understood that the same identical mounting structure is employed to operatively support the left end of the pressure roller 46. As illustrated in FIG. 5, the pressure roller 46 is operatively mounted by suitable roller bearings (not shown), on a horizontal shaft 58. The pressure roller shaft 58 is movably mounted in a pair of left and right cam plates, generally indicated by the numerals 59 and 60 in FIGS. 1 and 5, respectively. The cam plates 59 and 60 are made from any suitable material as, for example, a plastic material having good inherent lubricative properties, such as the well known plastic material of this type available on the market under the trade name "TEFLON".

As illustrated in FIG. 5, the right cam plate 60 is mounted on the inside surface of a vertical steel mounting plate 61 which is positioned against the inside surface of the vertical portions of the angle bracket members 55, 56 and 57, and secured thereto by any suitable means, as by a plurality of suitable machine screws 62, which also pass through the right cam plate 60 and hold both of the plates 60 and 61 to the carrier bracket 54.

As shown in FIG. 1, the mounting plate 61 has formed therethrough an inverted, L-shaped slot having an upper horizontal portion 63 and a communicating vertical portion 64. The cam plate 60 is also provided with an inverted, L-shaped slot, which has an upper horizontal portion 60 and a communicating vertical portion 66. The L-shaped slot in the cam plate 60 functions as an L-shaped cam track. The width of each of the L-shaped cam track portions 65 and 66 in the cam plate 60 is slightly larger than the diameter of the pressure roller shaft 58, so as to permit the shaft 58 to slide in said L-shaped cam track in a free and easy manner, but yet without any excessive clearance. The corresponding L-shaped slot, with its portions 63 and 64 in the steel plate 61, is formed to a width larger than the width of the cam track portions 65 and 66, so that the cam plate 60 extends beyond the edges of the slot portions 63 and 64 in the mounting plate 61, to permit the pressure roller shaft 58 to slide only on the surfaces of the cam track in the self-lubricating cam plate 60. As stated hereinbefore, the left end of the pressure roller shaft 58 is similarly mounted in a similar L-shaped cam track formed in the left cam plate 59, and the cam plate 59 is similarly supported by a steel plate 61 in the left side carrier bracket 53.

The pressure roller 46 is advanced or moved through a liquid extraction operation on a short yarn wet mop, between the upper retracted, inoperative or initial position shown in FIG. 1 and the lower position shown in FIG. 3, by the following described structure.

The means for advancing the pressure roller 46 from the retracted initial position of FIG. 1 to the advanced or end of an operative movement, shown in FIG. 3, is attached to both ends of the pressure roller shaft 58, and the structure attached to the right end of the shaft 58 is illustrated in FIGS. 4 and 5. It will be understood that similar pressure roller advancement structure is attached to the left end of the pressure roller shaft 58.

As shown in FIG. 5, a spacer sleeve 70 is slidably mounted on the pressure roller shaft 58, with the inner end thereof abutting the outer face of the plate 61, and the outer end thereof abutting one leg of a U-shaped cable attachment bracket, generally indicated by the numeral 71. The cable attachment bracket 71 is pivotally mounted on the shaft 58 and includes a horizontal plate 72, which is disposed below the shaft 58 and a pair of integral, laterally spaced apart, vertical mounting plates 73 and 74 which are pivotally mounted on the shaft 58. The cable attachment bracket 71 is held against longitudinal movement on the shaft 84 by a suitable, releasable clip retainer member 75, which has one leg thereof releasably mounted through a hole 76 formed through the shaft 58, between the cable bracket attachment plates 73 and 74.

As shown in FIG. 5, the upper end of a pressure roller advancement cable 77 extends through the cable attachment bracket plate 72, and into a fixed engagement with a cable retainer member 78 that secures the upper end of the cable 77 to the cable attachment bracket 71. As shown in FIG. 2, the cable 77 extends downwardly and under, and around a first pulley 79, and thence forwardly and over, and down around a second pulley 80. The pulleys 79 and 80 are rotatably mounted on suitable shafts 81 and 82, respectively, which are operatively mounted on the vertical outside surface of the cart frame side support member 34. As shown in FIG. 2, the end of the cable 77 is fixedly secured, by any suitable means, to the right end of a transverse attachment tube 86. The pressure roller advancement cable 77 for the left side of the liquid extraction structure is illustrated in FIG. 3, and it is also mounted around suitable pulleys 79 and 80 which are mounted on the cart support frame 24, in the same manner as the pulleys 79 and 80 are mounted on the support member 34. The forward end of the left cable 77 is secured, by any suitable means, to the left end of the cable attachment tube 86.

As shown in FIG. 3, the cable attachment tube 86 is fixed secured, as by welding, to the lower side of a pivotally mounted foot pedal 86. The foot pedal 87 comprises left and right forwardly, spaced apart, arms 88 and 92 which are integral at the forward ends with forwardly extended arms 89 and 90, respectively, which angle inwardly and forwardly and terminate at an integral transverse foot engaging portion elongated member 90. As shown in FIG. 3, the left foot pedal arm 88 is pivotally mounted on a suitable shaft 93, that is operatively mounted on the lower end of the left vertical support member 12. As illustrated in FIGS. 2 and 4, the right foot pedal arm 92 is similarly pivotally mounted on a suitable shaft 94, which is operatively carried on the lower end of the right vertical support shaft 13.

The return means or retraction apparatus for returning the pressure roller 46 from the end travel position 120 as shown in FIG. 4, after it has performed a liquid extraction operation and back up to the inoperative or initial position 119 shown in FIG. 1 comprises a pair of return air cylinders, generally indicated by the numerals 98 and 99, in FIGS. 2 and 3. It will be understood that other return means could be employed, as for example a hydraulic cylinder, a spring cylinder, or the like. As illustrated in FIG. 1, the air cylinder 99 includes the usual cylinder body 100 from which extends upwardly a cylinder rod 101. Operatively mounted on the upper end of the cylinder rod 101 is an L-shaped, rotatable ball connector member 102 which has one end operatively connected to the outer end of the pressure roller shaft 58 and the other end operatively connected to the upper end of the cylinder rod 101. The lower end of the cylinder body 100 is attached by a second L-shaped, rotatable ball connector member 13 which has one end fixedly connected to the lower end of the cylinder body 100 and the other end rotatably connected to a shaft 104 which is fixed to the outer side of the support frame horizontal member 34. The return cylinder 98 on the left side of the liquid extractor means has its lower end pivotally mounted in a similar manner on the outer side of the frame support member 24.

Figure 7:
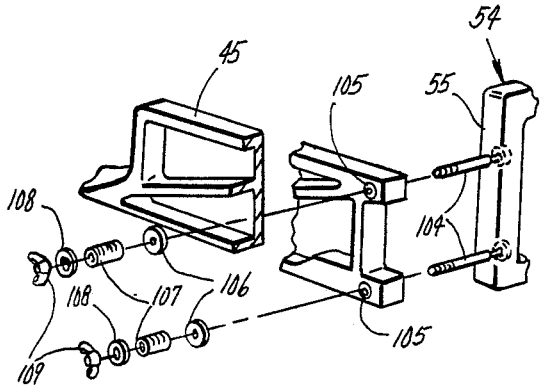
FIG. 7 is a fragmentary, broken, pespective view of the resiliently mounted pressure plate, and showing the spring mounting structure for said plate.

The resiliently mounted pressure plate 45 is mounted on the carrier brackets 53 and 54 by the following described structure. As illustrated in FIG. 7, the right end of the pressure plate 45 is seated against the outer face of the bracket portion 55. The right end of the pressure plate 45 is resiliently mounted on the bracket portion 55 by a pair of suitable bolts 10 which extend through the bracket portion 55 and through a pair of holes 105 in the pressure plate 45. Operatively mounted on each of the bolts 104, on the outer side of thepressure plate 45, are a pair of washers 106 and 108, between which is seated a coil spring 107. The washers 106 and 108, and the spring 107, are retained on each of the bolts 104 by a wing nut 109. As shown in FIGS. 1 and 2, the left end of the pressure plate 45 is connected to the carrier bracket 53 by the same resilient mounting structure, and the same reference numerals have been applied to that structure.

Figure 6:
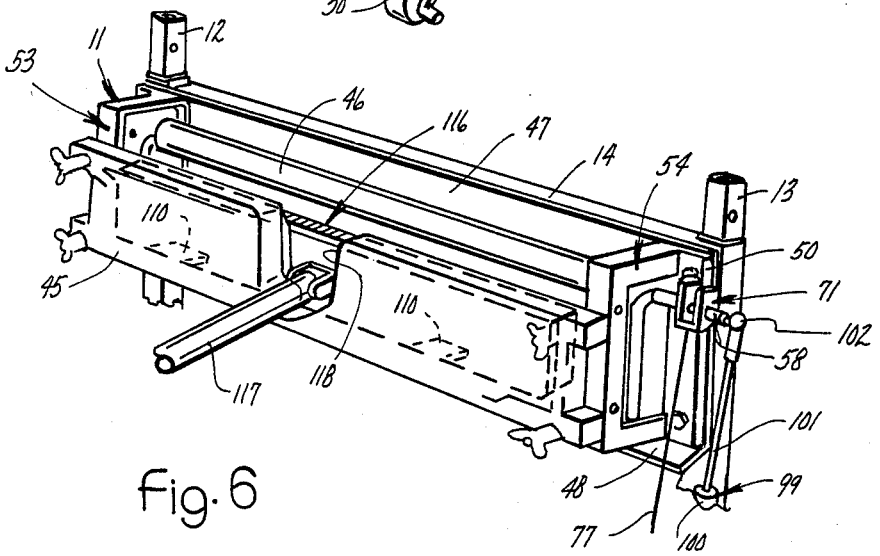
FIG. 6 is a fragmentary, elevation perspective view of the resiliently mounted pressure plate and pressure roller, and showing a short yarn wet mop positioned inside of the resiliently mounted pressure plate, and ready for the commencement of a liquid squeezing operation.

As illustrated in FIG. 6, the pressure plate 45 is provided on the inside surface thereof with a pair of longitudinally spaced apart, integral, inwardly extended stop members 110 on which a mop, generally indicated by the numeral 116, is adapted to be seated when it is put in the liquid extraction means. As shown in FIG. 3, a pair of cantilever spring members 111 are mounted in laterally spaced apart positions on the inner face of the mounting plate 47 by suitable screws 112 and nuts 113. The springs 111 are extended inwardly and toward the pressure plate 45 so as to engage a mop 116 placed on the inner face of the pressure plate 45 to assist in holding it in place on the stops 110. The numeral 117 in FIG. 6 illustrates the usual handle for the mop 116.

In use, the operator would first put his short yarn, wet mop in the front pail or bucket 43, which would be filled with suitable clean wash water that may contain a germicidal or other desired chemicals. The operator then places the wet mop 116 inside of the pressure plate 45 and holds it against the same by means of the handle 117 which is extended through the U-shaped opening 118 that is formed through the mid point of the pressure plate 45. The mop rests on the stops 110. The operator then exerts a pressure with his foot on the foot pedal 87 so as to move it downwardly to the position shown in FIG. 3. The downward movement of the foot pedal 87 pulls the cables 77 downwardly, which action moves the pressure roller 46, from its upper initial position 119, forwardly and its shaft 58 along the horizontal cam track portions 63 and thence downwardly through the vertical cam track portions 64 into a rolling pressure engagement with the short yarn on the wet mop 116. The pressure roller 46 is moved downwardly to the lower end of its liquid extraction movement, to the position indicated by the numeral 120 in FIGS. 3 and 4. During the downward movement, the pressure roller 46 moves over the yarn face of the wet mop 116, and the resiliently mounted pressure plate 45 is moved slightly outwardly from the solid line position shown in FIG. 4 to the broken line position indicated by the numeral 121. As shown in FIG. 3, when the pressure roller 46 is in the end travel position 120 the air cylinder 99 is compressed so that when the operator removes his foot from the foot pedal 87 the air cylinders 98 and 99 function to return the pressure roller 46 upwardly and back to its initial position, indicated by the numeral 119 in FIG. 4.

The liquid extraction means 11 of the present invention provides any desired degree of dampness which the operator wishes to leave on the mop 116. It will be understood that during the liquid extraction operation the liquid extracted from a mop 116 falls downwardly into the rear pail 44, and any of the fluid which may move backwardly is directed by the mounting plate 47 and a splash guard plate 48 downwardly into the rear pail 44.

It will be seen that the degree of wetness can be varied by varying the spring pressure effected by the coil springs 107, by adjusting such pressure by means of the wing nuts 109.

I claim:

1. A wet mop liquid extractor comprising:

(a) a support frame having a mounting plate vertically and laterally disposed thereon and spaced above the lower end of the support frame and carrying a pair of laterally spaced apart support brackets extending forwardly therefrom;

(b) a resiliently mounted pressure plate carried by said pair of support brackets in a position spaced forwardly from the mounting plate on said support frame, and with means to adjust the resilient pressure on the pressure plate to provide a desired degree of dampness in a mop after a liquid extraction operation thereon;

(c) a pressure roller movably mounted on said support frame;

(d) foot operated means connected to the ends of the pressure roller for moving said movable pressure roller from an upper initial position through a rolling, squeezing engagement with a wet mop placed against the inner side of the resiliently mounted pressure plate to a lower end travel position, so that pressure is applied against a small area of the mop at any one time to maximize the squeezing pressure on the mop to extract the liquid therefrom;

(e) a pair of inverted L-shaped cam means carried on said support brackets and slidably engaged with the ends of the pressure roller for controlling the movement of the movable pressure roller when it is moved by the foot operated means from the upper initial position through a first upper forward horizontal mop engaging movement and thence through a vertical downward liquid extracting movement over a wet mop; and, (f) a compression means operatively connected to said pressure roller for automatically returning said movable pressure roller to its upper initial position after a foot operated liquid extraction movement, said compression means being compressed during movement of the pressure roller from the upper initial positon to the lower end travel position.

2. A wet mop liquid extractor as defined in claim 1, wherein:

(a) said support frame removably supports a catch pail positioned below the resiliently mounted pressure plate for catching liquid extracted from a wet mop positioned against the resiliently mounted pressure plate.

3. A wet mop liquid extractor as defined in claim 2, wherein:

(a) said support frame removably supports a fresh liquid pail for holding a supply of clean liquid, into which a wet mop is first dripped before placing the mop on the resiliently mounted pressure plate for extracting the liquid from the mop to leave it in a damp condition for a mopping operation.

4. A wet mop liquid extractor as defined in claim 2, wherein:

(a) said support frame is provided with guard splash plate for directing liquid extracted from a wet mop downwardly into the catch pail.

5. A wet mop liquid extractor as defined in claim 1, wherein:

(a) said foot operated means for moving said movable pressure roller into a rolling, squeezing engagement with a wet mop includes a foot operated pedal means.

6. A wet mop liquid extractor as defined in claim 1, wherein:

(a) said means for returning said movable pressure roller to its initial position from the end travel position after a liquid extraction movement comprises at least one air cylinder.

7. A wet mop liquid extractor as defined in claim 1, wherein:

(a) said support frame is provided with roller means.

* * * * *